US012310485B2

(12) United States Patent
Henrot et al.

(10) Patent No.: US 12,310,485 B2
(45) Date of Patent: May 27, 2025

(54) SLIDING CLASPS FOR ADJUSTABLE STRAPS

(71) Applicant: Apple Inc., Cupertino, CA (US)

(72) Inventors: Camille I Henrot, San Francisco, CA (US); Bryan A Cloyd, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 276 days.

(21) Appl. No.: 17/688,582

(22) Filed: Mar. 7, 2022

(65) Prior Publication Data

US 2022/0346531 A1 Nov. 3, 2022

Related U.S. Application Data

(60) Provisional application No. 63/183,526, filed on May 3, 2021.

(51) Int. Cl.

| | |
|---|---|
| ***A44B 11/06*** | (2006.01) |
| ***A44B 11/10*** | (2006.01) |
| ***A45F 3/00*** | (2006.01) |
| ***A45F 3/14*** | (2006.01) |

(52) U.S. Cl.
CPC ..... *A45F 3/14* (2013.01); *A44B 11/10* (2013.01); *A45F 3/005* (2013.01)

(58) Field of Classification Search
CPC ..... A44C 5/00; A44C 5/0053; A44C 11/005; A44C 5/185; A44C 5/22; A44C 15/005; Y10T 24/3987; Y10T 24/3936; Y10T 24/3942; Y10T 24/3944; Y10T 24/3951; A44B 11/02; A44B 11/06; A44B 11/12; A44B 11/125; A44B 11/16; A44B 11/10; A45F 3/14; A45F 3/005
See application file for complete search history.

(56) References Cited

U.S. PATENT DOCUMENTS

| | | | | |
|---|---|---|---|---|
| 80,676 A * | 8/1868 | Soule | A44B 11/24 | 63/11 |
| 118,294 A * | 8/1871 | Steven | A44C 5/00 | 63/3.2 |
| 1,708,470 A * | 4/1929 | Eckert | A44C 5/22 | 24/122.3 |
| 2,462,425 A * | 2/1949 | Pratt | A44C 11/005 | 63/3 |
| 3,660,875 A | 5/1972 | Gutman | | |
| 3,867,905 A * | 2/1975 | Vail, Jr. | A01K 27/005 | D30/153 |
| 4,262,395 A | 4/1981 | Kosky | | |

(Continued)

*Primary Examiner* — Jack W Lavinder
(74) *Attorney, Agent, or Firm* — Treyz Law Group, P.C.; G. Victor Treyz; Kendall P. Woodruff

(57) ABSTRACT

A strap may have a strip of material. Sliding clasps may be attached to ends of left and right segments of the strip. Each sliding clasp may have a slot through which one of the segments slides to adjust strap length. The strap may be coupled to an item such as a device with a battery. The sliding clasps are each in a first mode in which the sliding clasp is locked to the strip and does not allow the strip to slide and a second mode in which the sliding clasp is unlocked and allows the strip to slide. Rotational motion, squeezing motions, and/or other motions may be used to transition the sliding clasp between locked and unlocked states.

26 Claims, 13 Drawing Sheets

(56) References Cited

U.S. PATENT DOCUMENTS

| | | | | |
|---|---|---|---|---|
| 4,321,804 | A * | 3/1982 | Borofsky | A44C 5/22 63/3.2 |
| 4,334,413 | A * | 6/1982 | Gaston | A44C 5/22 63/3.2 |
| 4,912,814 | A * | 4/1990 | McKenzie | F16G 11/14 24/66.9 |
| 5,437,401 | A | 8/1995 | Seltzer | |
| 6,837,409 | B2 | 1/2005 | Lemanski, II | |
| 7,174,859 | B2 * | 2/2007 | Lee | A44C 11/005 2/338 |
| 7,600,660 | B2 | 10/2009 | Kasper et al. | |
| 2006/0273128 | A1 | 12/2006 | Balakier | |
| 2007/0022778 | A1 * | 2/2007 | Ferlise | A44C 5/22 63/15.65 |

* cited by examiner

SLIDING CLASPS FOR ADJUSTABLE STRAPS

This application claims the benefit of provisional patent application No. 63/183,526, filed May 3, 2021, which is hereby incorporated by reference herein in its entirety.

FIELD

This relates generally to straps, and, more particularly, to straps with slider mechanisms.

BACKGROUND

It is sometimes desirable to provide items such as electronic devices with straps. Straps may allow devices to be worn or carried by a user.

SUMMARY

An adjustable-length strap may be coupled to an item such as a device with a battery. The strap may have a strip with left and right portions that are coupled together using sliding clasps. The sliding clasps may be operated in a locked mode in which the clasps are locked onto the strip portions. The sliding clasps may also be operated in an unlocked mode in which the strip portions slide relative to the clasps.

A first of the clasps may have a slot that allows the first clasp to slide along the right portion of the strip in the unlocked mode and a second of the clasps may have a slot that allows the second clasp to slide along the left portion of the strip in the unlocked mode. This allows the length of the strap to be adjusted.

The clasps may be configured to change between the locked and unlocked modes in response to rotational motion of portions of the clasps with respect to each other, squeezing motion on end portions of the clasps, and/or other actions.

DETAILED DESCRIPTION

Electronic devices and other items may be provided with straps. For example, a battery pack or a portable electronic device such as a cellular telephone may be provided with a fixed-length or adjustable-length carrying strap. Straps may be held in a user's hands, worn about a user's neck, worn across a user's body, and/or may otherwise be held or worn by a user.

Figure 1:
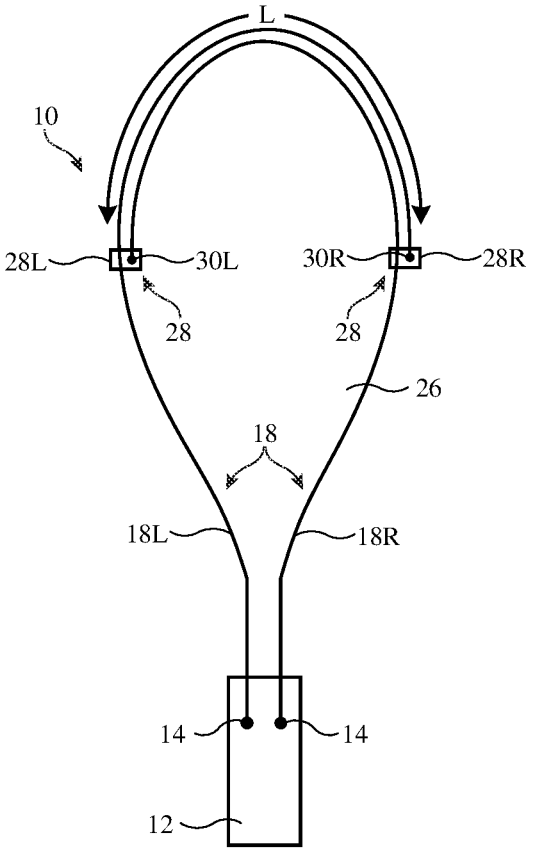
FIG. 1 is a diagram of an illustrative strap and associated device in accordance with an embodiment.

FIG. 1 is a diagram of an illustrative strap and associated item coupled to the strap. As shown in FIG. 1, strap 10 may have a loop that allows strap 10 and an item such as item 12 that is coupled to strap 10 to be carried by a user. Item 12 may be coupled to strap 10 using a fixed or removable attachment mechanism. Strap 10 may, as an example, have a pair of ends coupled respectively to each of a pair of connections 14 in item 12. Connections 14 may include grooves in item 10 that receive protruding snaps on strap 10, may include magnetic attachment mechanisms, may include screws and/or other fasteners, may include adhesive, and/or may be implemented using other connection mechanisms. Strap 10 may be a cross-body strap, a wrist strap, a loop that can be held in a user's hand or worn about a user's neck, or other suitable strap.

Item 12 may include electronic equipment (e.g., an electronic device such as a battery pack, a cellular telephone, a tablet computer, other electronic equipment, etc.) and/or may include a carrying case that is removably attached to an electronic device.

Item 12 may include a display, buttons, touch sensors, force sensors, optical sensors, microphones for gathering voice input, and/or other sensors and input-output devices for gathering user input and providing a user with output, may contain a battery in addition to some or all of these components, or may contain a battery without substantial additional input-output devices (e.g., item 12 may be a supplemental battery pack for powering an electronic device with a display and other components). Wires may be coupled between item 12 and an electronic device such as a device with a display and control circuitry and/or other electronic device to transfer power and/or data.

Strap 10 may be formed from an elongated strip of material such as strip 18. Strip 18, which may sometimes be referred to as a strap or band, may be flexible so that strip 18 may be folded back on itself to form a loop. The width of strip 18 is preferably at least two times, at least five times, or at least ten times greater than its thickness. The thickness of strip 18 may be, as an example, 0.5 mm to 5 mm, at least 1 mm, at least 2 mm, less than 4 mm, or other suitable thickness. Strip 18 may be formed from one or more layers of flexible material including polymer, flexible magnets, fabric, flexible metal, adhesive, natural materials such as cotton, other materials, and/or combinations of these materials. As an example, strip 18 may contain a strip-shaped elongated flexible magnet covered by one or more layers of polymer, fabric, leather, etc. The flexible magnet may, in an illustrative arrangement have poles (e.g., 2-10 poles or other suitable number of poles) that run along the length of strip 18 and that alternate in polarity as a function of distance across the width of strip 18. The flexible magnet may be arranged so that overlapping left and right portions of strip 18 attract each other.

Strip 18 may be formed from a uniform length of material (with one or more sublayers) and/or different segments along the length of strip 18 may have different internal and/or external layer(s) of material. As an example, an end portion of strip 18 may have an exterior surface formed from fabric, whereas remaining portions of strip 18 may have an exterior surface formed from leather. If desired, all of strip 18 may be leather or all of strip 18 may be formed from fabric. Polymer layers and/or other materials may also be used to cover some or all of strip 18. For example, the surface of a portion of strip 18 may be covered with a layer of polymer or other material that is not present on other portions of strip 18.

Strap 10 may have adjustable clasps. For example, strap 10 may have sliding clasps. Sliding clasps, which may sometimes be referred to as sliders, may slide along strap 10 when length adjustments are desired. In the example of FIG. 1, strap 10 has a pair of sliders 28. Using sliders 28, a looped length of strip 18 may form loop 26 in strap 10. Strip 18 may have a right-hand portion (segment) such as right strip 18R and a left hand portion (segment) such as left strip 18L. Adjustable clasp mechanisms such as sliders 28 may be used to slidably couple the ends of strips 18R and 18L to portions of strips 18L and 18R, respectively. Each slider 28 may have a first slot or other portion that receives a portion of strip 18 for sliding motion. Each slider 28 may also have a second slot or other structure that serves as a location for a fixed attachment between that slider and an end of strip 18.

Figure 4:
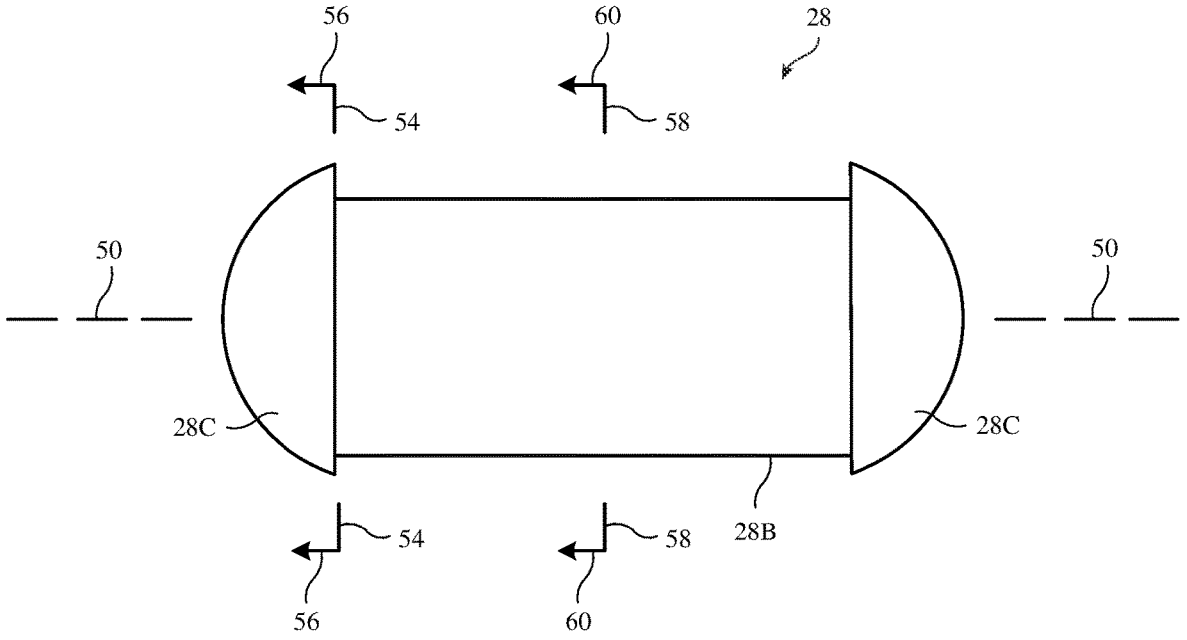
FIG. 4 is a view of an illustrative slider showing how the slider may have a body and end caps in accordance with an embodiment.

In the example of FIG. 1, right strip 18R is slidably received within a slot in slider 28R, which allows slider 28R to slide relative to strip 18R. Similarly, left strip 18L is slidably received within a slot in slider 28L, which allows slider 28L to slide along the length of left strip 18L. The ends of left strip 18L and right strip 18R are attached to sliders 28R and 28L, respectively. As shown in FIG. 4, the end of right strip 18R may be fixedly attached to slider 28L using fixed attachment mechanism 30L. The end of left strip 18R may be fixedly attached to slider 28R using fixed attachment mechanism 30R. As examples, attachment mechanisms 30L and 30R may be implemented by forming locally thickened ends in strip 18 that prevent these ends from pulling through the second slots, may include pins that capture the ends in strip 18, may use fixed clips at the ends of strip 18, may use sewn loops at the ends in strip 18 to attach the ends to the sliders, and/or may have other structures that attach the ends of strip 18 to the sliders.

With this type of arrangement, attachment mechanism 30R holds the end of strip 18L in place on slider 28R, while the slot in slider 28R allows slider 28R to slide along the length of strip 18R. Attachment mechanism 30L holds the end of strip 18R in place on slider 28L, while the slot in slider 28L allows slider 28L to slide along the length of strip 18L. In this way, the separation distance L between sliders 28 along strap 10 may be adjusted. To shorten strap 10, slider 28L and/or slider 28R is moved along strip 18 towards item 12 (e.g., sliders 28 are moved apart to increase L and reduce the size of loop 26). To lengthen strap 10 and increase the size of loop 26, sliders 28 are moved towards each other, which decreases L and increases the size of loop 26. If desired, flexible magnetic structures may be embedded within some or all of strip 18 (e.g., at least in the portion of strip 18 between sliders 28) to help hold strips 18L and 18R next to each other (e.g., to reduce tangling).

Figure 2:
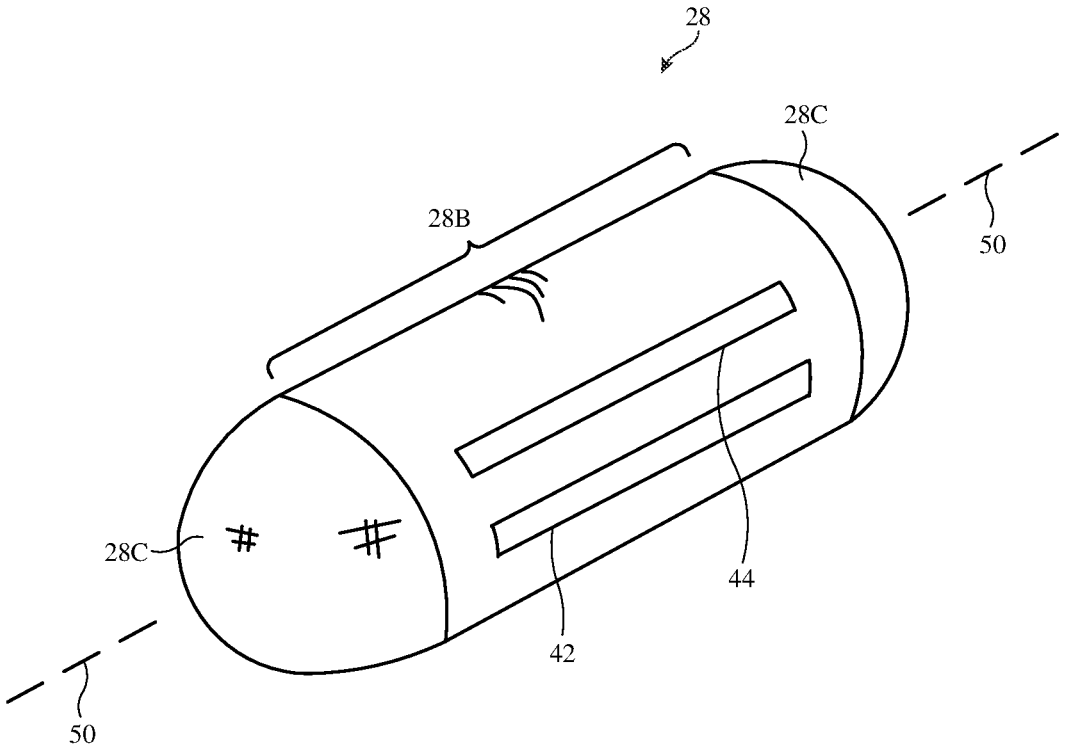
FIG. 2 is a perspective view of an illustrative slider (sliding clasp) in accordance with an embodiment.

Sliders 28 may be formed from one or more structures joined together using press-fit connections, adhesive, fasteners, welds, and/or other attachment mechanisms. A perspective view of an illustrative slider 28 is shown in FIG. 2. In the example of FIG. 2, slider 28 has main slider body 28B (formed from a single housing member or multiple housing members joined together) and a pair of end caps 28C at opposing ends of body 28B. Slider 28 in this type of configuration has a capsule shape (sometimes referred to as a pill shape). Other shapes for slider 28 (e.g., box shapes, box shapes with eased edges, etc.) may be used, if desired. Slider 28 may be formed from metal, polymer, ceramic, other materials, and/or combinations of these materials.

As shown in FIG. 2, body 28B may have a through-hole opening such as first slot 42 that passes entirely through body 28B and that receives a portion of strip 18 (e.g., portion 18A) for sliding motion (e.g., slot 42 receives strip portion 18A while allowing that portion of strip 18 to slide with respect to slider 28). Slider 28 may be configured to provide friction in slot 42 so that slider 28 is maintained in place on strip 18 until deliberately moved by a user to adjust the length of strap 10. In an illustrative configuration, which is described herein as an example, slider 28 can be operated in a first mode, sometimes referred to as an unlocked mode, in which friction is low so that strip 18 slides freely in slot 42 and can be operated in a second mode, sometimes referred to as a locked mode, in which friction is increased to that strip 18 is held in place and does not slide freely in slot 42.

Body 28B may have a second slot such as slot 44. Slot 44 may be a through-hole slot or a one-sided slot (a non-through-hole slot). The end of a portion of strip 18 may be received within slot 44 and attached to slider 28.

In some configurations, body 28B and caps 28C may rotate relative to each other about longitudinal slider axis 50 or caps 28C may move in and out along axis 50. These movements may be used, for example, to lock and unlock strap 18 (e.g., so that strap 18 is captured and length L in loop 26 of FIG. 1 is fixed or so that strap 18 is permitted to slide freely within slot 42 to allow loop length adjustments).

Figure 3:
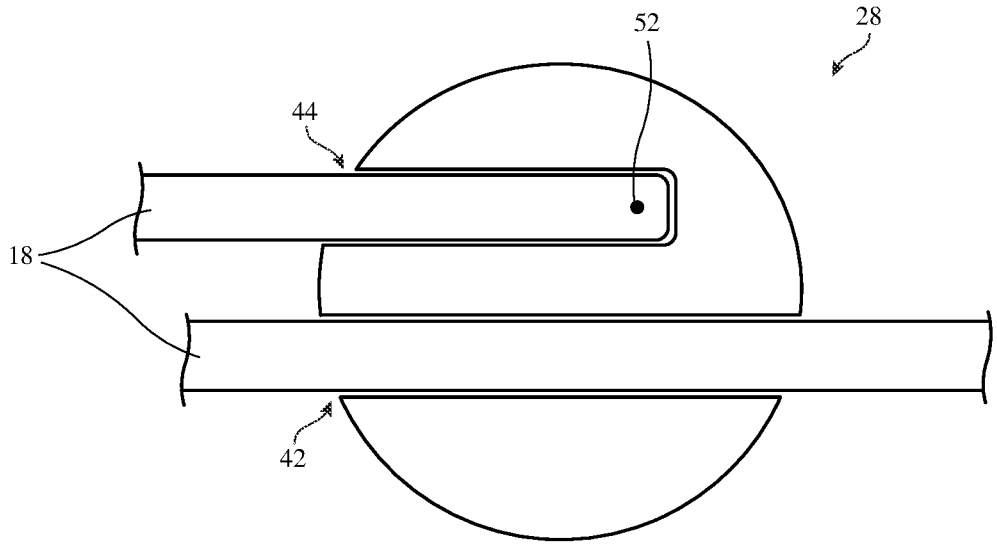
FIG. 3 is a cross-sectional view of an illustrative slider in accordance with an embodiment.

As shown in FIG. 3, a loop or other structure may be formed in an end portion of strip 18 that is received within slot 44 and this loop may be secured to body 28B using a strip retention member such as strip retention pin 52 and/or other attachment mechanisms may be used to attach an end of strip to slider 28.

Figure 5:
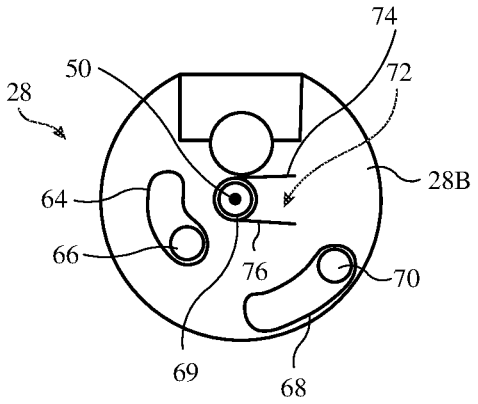
FIGS. 5, 6, 7, and 8 are cross-sectional views of the slider of FIG. 4 in accordance with embodiments.
Figure 7:
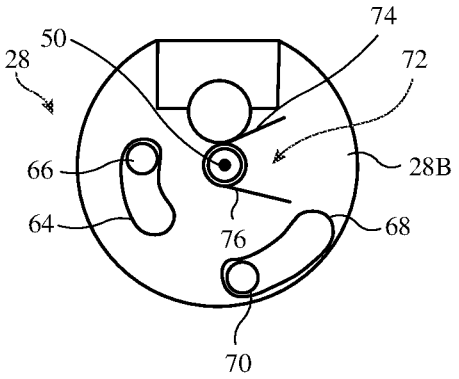
Figure 6:
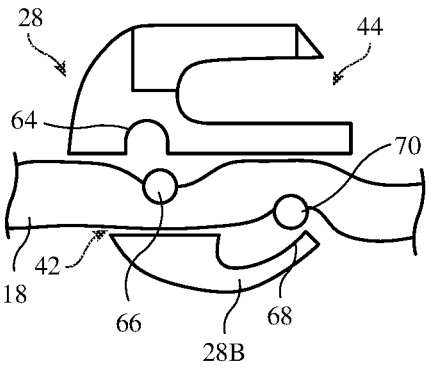
Figure 8:
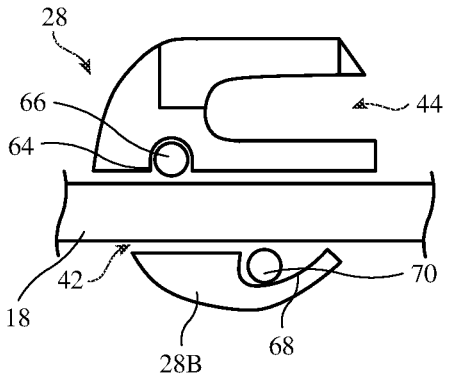

FIG. 4 is a side view of slider 28 in an illustrative configuration in which end caps 28C can be rotated clockwise and counterclockwise about axis 50 relative to body 28B to lock and unlock slider 28 (e.g., to fix slider 28 on strap 18 or to allow slider 28 to slide freely). FIGS. 5 and 7 are cross-sectional side views of slider 28 of FIG. 4 taken along line 54 and viewed in direction 56. FIGS. 6 and 8 are cross-sectional side views of slider 28 taken along line 58 and viewed in direction 60.

As shown in FIG. 5, slider 28 may have one or more springs such as spring 72 (e.g., a torsion spring). There may be, for example, a spring such as spring 72 between each end cap 28C and body 28B. Spring 72 may have a first end such as end 74 that is attached to body 28B and a second end such as end 76 that is attached to end cap 28C. An axle such as an axle formed from a metal shaft (e.g., shaft 69) or other structure may be used to allow end caps 28C and body 28B to rotate relative to each other about axis 50. Pins 66 and 70 may each extend between the end caps of slider 28 and may slide within respective crescent-shaped slots 64 and 68 in body 28B. The torsion supplied by spring 74 causes pin 66 to slide within slot 64 towards strip 18 and causes pin 70 to slide within slot 68 towards strip 18. As shown in FIG. 6, this forces pins 66 and 70 into the material of strip 18 and thereby engages strip 18 to prevent sliding motion of strip 18 relative to slider 28. In the configuration of FIGS. 5 and 6, slider 28 is in its locked position, because a braking action is created that imposes sufficient sliding friction on strap 18 to lock slider 28 in place along the length of strip 18. This friction is created by pressing pins 66 and 70 into the material of strap 18 in the examples of FIGS. 5 and 6, but other arrangements may be used, if desired (e.g., a locked configuration in which part of strip 18 is wound around one or more pins).

When a user twists body 28B relative to end caps 28C, ends 74 and 76 of spring 72 are rotated apart to load tension onto spring 72, as shown in FIG. 7. This rotation of end caps 28C relative to body 28B moves pins 66 and 70 out of contact with strip 18 as shown in FIG. 8. As a result, slider 28 operates in an unlocked mode in which strip 18 can slide freely within slot 42. When the user releases body 28B, spring 72 releases its built up tension and slider 28 returns to its normal locked state (FIGS. 5 and 6).

Figure 9:
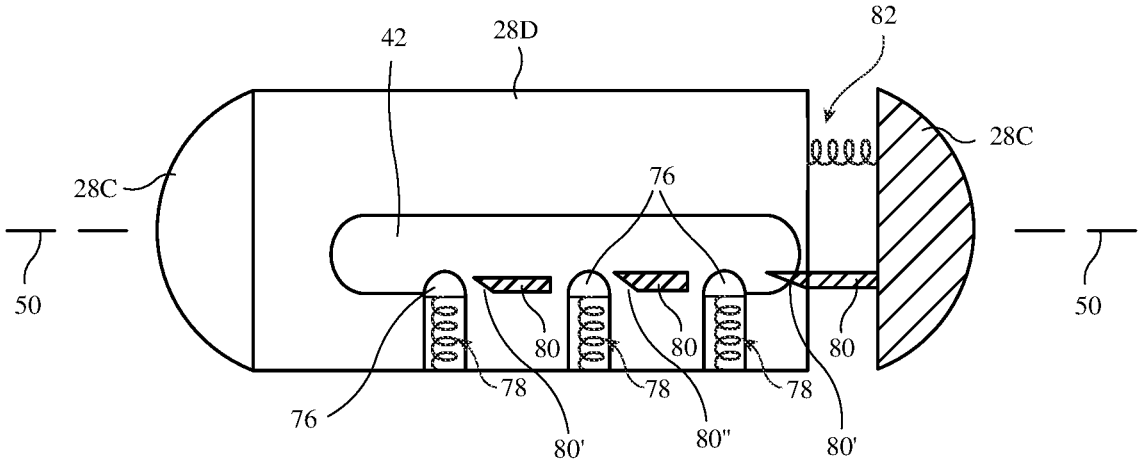
FIGS. 9 and 10 are cross-sectional views of illustrative sliders with brake and cam mechanisms in accordance with embodiments.

In the example of FIGS. 4, 5, 6, 7, and 8, a strap sliding brake was formed using a rotating brake mechanisms. If desired, slider 28 may be locked and unlocked in response to axial motion of one or more of end caps 28C relative to body 28B along axis 50. Consider, as an example, the arrangement of FIG. 9. In this configuration, a strap brake is formed using one or more brake members 76 (e.g., brake pads with curved surfaces and/or surfaces of other shapes). Brake members 76 are each biased inwardly into slot 42 using respective biasing structures such as springs 78. The right-hand end cap 28C of FIG. 9 is coupled to an elongated plunger member such as member 80 that includes cam surfaces 80' that are configured to bear against brake members 76 when the end cap is pressed towards body 28B. Spring 82 normally pushes the end cap away from body 28B and thereby moves the cam surfaces of plunger member 80 away from brake members 76. As a result, brake members 76 are normally pushing into strip 18 in slot 42 and so that slider 28 is in a locked state and is located at a fixed position on strip 18. Texture, elastomeric coating material, and or other structures may be provided as part of members 76 so that members 76 may grip strip 18 satisfactorily. When it is desired to unlock slider 28, a user presses end cap 28C towards body 28B, compressing spring 82 and pushing cam surfaces 80' of plunger member 80 against brake members 76. Cam surfaces 80' of member 80 move brake members 76 out of engagement with strip 18 and compress springs 78, thereby unlocking slider 28 and allowing strip 18 to slide freely within slot 42.

Figure 10:
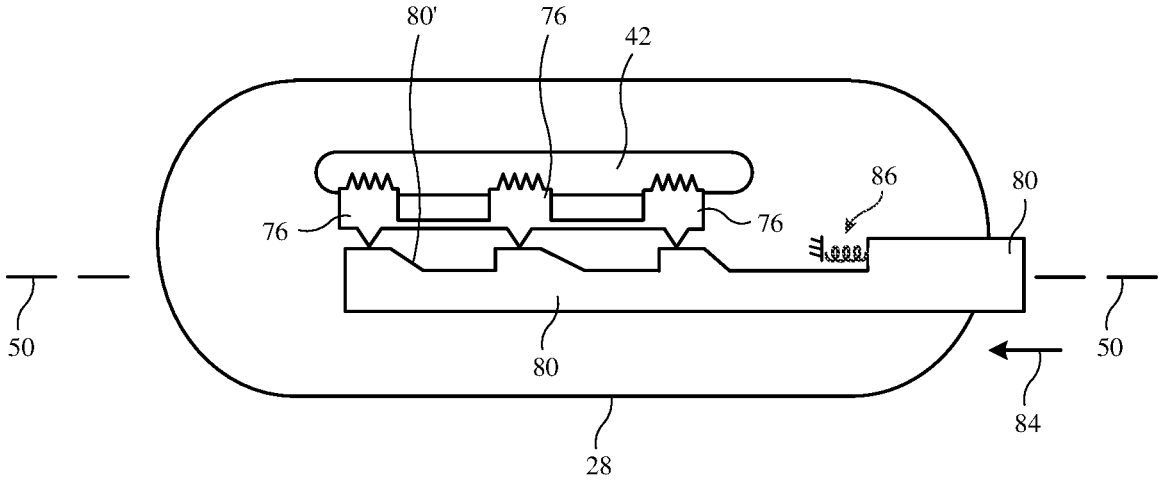

FIG. 10 shows an illustrative configuration for slider 28 in which plunger member 80 may extend out of one of the ends of a capsule-shaped body (body 28B of FIG. 10). The tip of member 80 that is exposed may form a button surface. Springs or other biasing structures may be provided to bias members 76 away from slot 42. Cam surfaces 80' of member 80 are configured to release brake member(s) 76 so that strip engagement features such as brake surface texture, elastomeric brake member coatings, etc. disengage from strip 18 in slot 42 when member 80 is pressed inwardly in direction 84 to overcome the expansion force from spring 86. Releasing the strap brake in this way allows strip 18 to slide freely within slot 42. When member 80 is released to lock slider 28, spring 86 pushes plunger 80 outwardly along axis 50. The cam surfaces on member 80 then press the brake into slot 42 to hold strip 18 in place.

Figure 11:
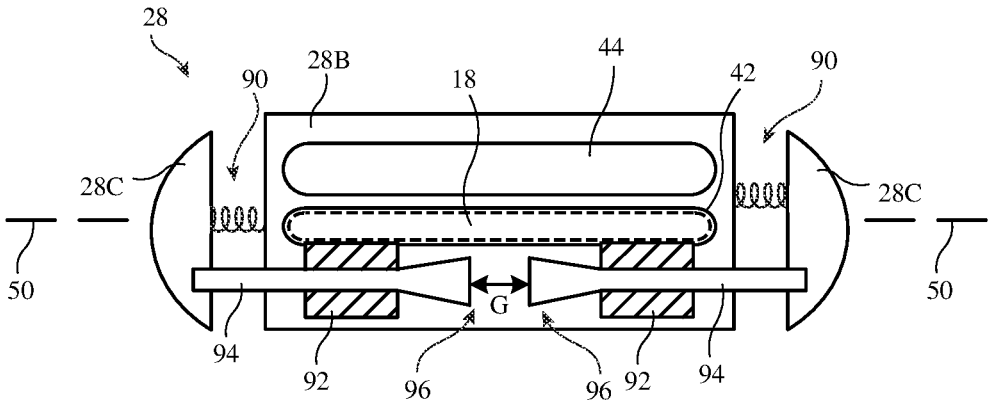
FIGS. 11, 12, 13, and 14 are cross-sectional views of illustrative sliders with controllable rollers in accordance with embodiments.
Figure 12:
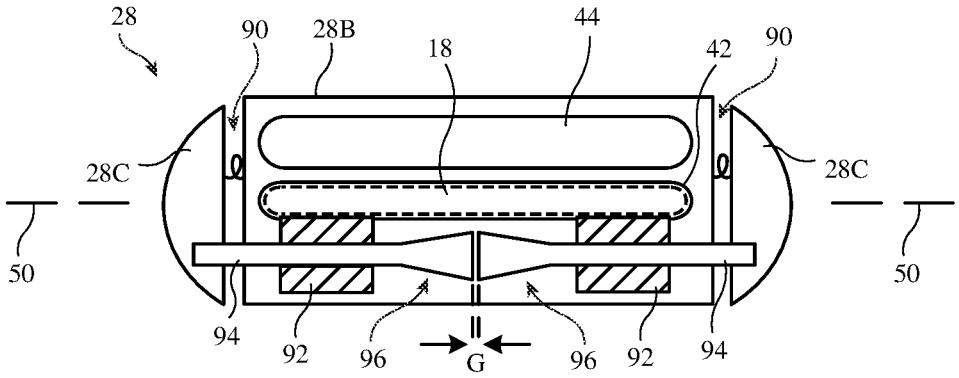

Locking and unlocking functionality may also be implemented using lockable rollers. This type of operation is shown in the illustrative slider of FIGS. 11 and 12. As shown in FIG. 11, slider 28 may have rotating members such as rollers 92 (e.g., hollow cylindrical members sometimes referred to as bushings or bearings). Rollers 92 may be mounted on shafts (axles) such as shaft members 94 for rotational motion. Rollers 92 may have surface texture, elastomeric coatings, and/or other features that allow rollers 92 to grip the surface of strap 18 in slot 42. Shaft members 94 may be coupled to end caps 28C and may normally be biased outwardly (parallel to axis 50) by springs 90. This forces tapered portions 96 of shaft members 94 towards and partly into the central bores of rollers 92 as shown in FIG. 11. The resulting friction between tapered portions 96 and rollers 92 prevents rollers 92 from rotating about the longitudinal axes of shaft members 94. When it is desired to unlock slider 28 of FIG. 11, a user presses inwardly on end caps 28C, thereby compressing springs 90, as shown in FIG. 12. This forces tapered portions 96 away from rollers 92 (and shrinks the size of gap G between the left shaft and right shaft). By disengaging tapered portions 96 from rollers 92 in this way, rollers 92 are no longer prevented from rotating. Straps 18 can thereby slide within slot 42.

Figure 13:
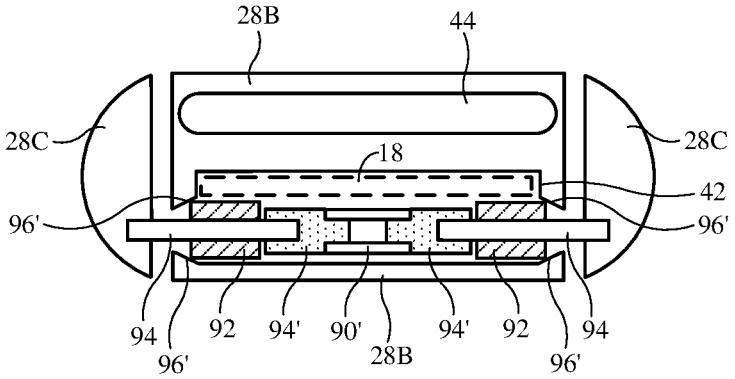
Figure 14:
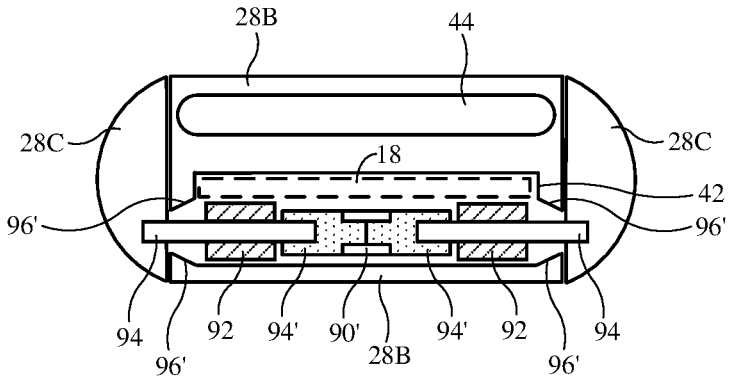

In the illustrative configuration of FIG. 13, tapered roller locking surfaces 96' are formed from integral portions of body 28B. Spring 90' is coupled to shaft structures such as members 94', which are fastened to the inner ends of shafts 94. In the configuration of FIG. 13, spring 90' is in its normal expanded state, which forces rollers 92 against surfaces 96' and locks rollers 92. By preventing rotation of rollers 92, strap 18 is held in place in slot 42. In the configuration of FIG. 14, a user has pressed inwardly on end caps 28C to compress spring 90' and move rollers 92 out of engagement with surfaces 96'. This unlocks slider 28 by allowing rollers 92 to rotate freely about shafts 94. Strip 18 can therefore slide within slot 42. Once the position of slider 28 along the length of strip 18 has been adjusted, the user may release end caps 28C to lock slider 28.

Figure 15:
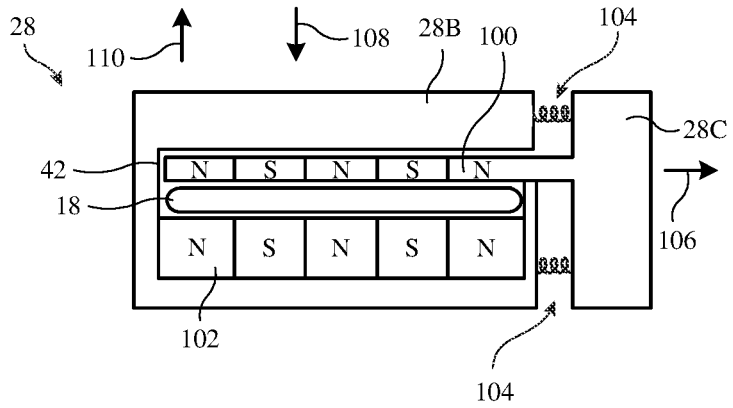
FIGS. 15 and 16 are cross-sectional views of illustrative sliders with magnetic brakes in accordance with embodiments.

Magnetic forces may be used to lock and unlock sliders 28. Consider, as an example, the arrangement of FIG. 15. As shown in FIG. 15, plunger member 100 of end cap 28C may be provide with one or more magnets. These magnet(s) may have poles with north polarity (N) and south polarity (S) alternating along the length of member 100. Body 28B may have one or more corresponding magnets 102 having a pattern of poles with the same pitch and same alternating pattern as the poles of plunger member 100. Springs 104, which extend between body 28B and end cap 28C, may be configured to normally force end cap 28C outward in direction 106. When expended outwardly, each north pole N of member 100 will be aligned with a corresponding south pole S of magnets 102 in body 28B and each south pole S of member 100 will be aligned with a corresponding north pole N of body 28B. These opposing magnetic poles attract each other and force member 100 in direction 108 to grip strip 18. In this configuration, slider 28 is locked. When it is desired to unlock slider 28, a user may press cap 28C toward body 28B to compress springs 104 and to move the poles of member 100 into alignment with poles of the same polarity in body 28B as shown in FIG. 15. By forcing each magnet pole of member 100 to be aligned with an overlap a magnetic pole of body 28B of opposite polarity, the poles of member 100 will repel the poles of body 28B, forcing member 100 in direction 110 away from strap 18.

Strip 18 of FIG. 15 may be free of magnets or may contain longitudinally extending flexible magnets (e.g., magnets that extend along the length of strip 18 and that have strip-shaped portions of north polarity extending along the length of strip 18 that alternate across the width of strip 18 with strip-shaped portions of south polarity extending along the length of strip 18). The number of different magnetic poles present across the width of strip 18 may match or be different than the number of different magnetic poles present across the width of magnets 102 and/or the number of different magnetic poles present along the length of member 100. The polarities of the poles of the magnets in strip 18 may oppose the polarities of the poles of magnets 102 or may be the same as the polarities of the poles of magnets 102 (as examples).

The magnets of slider 28 may, if desired, be sufficiently strong to overcome any magnetic opposition from the magnets of strip 18.

Figure 16:
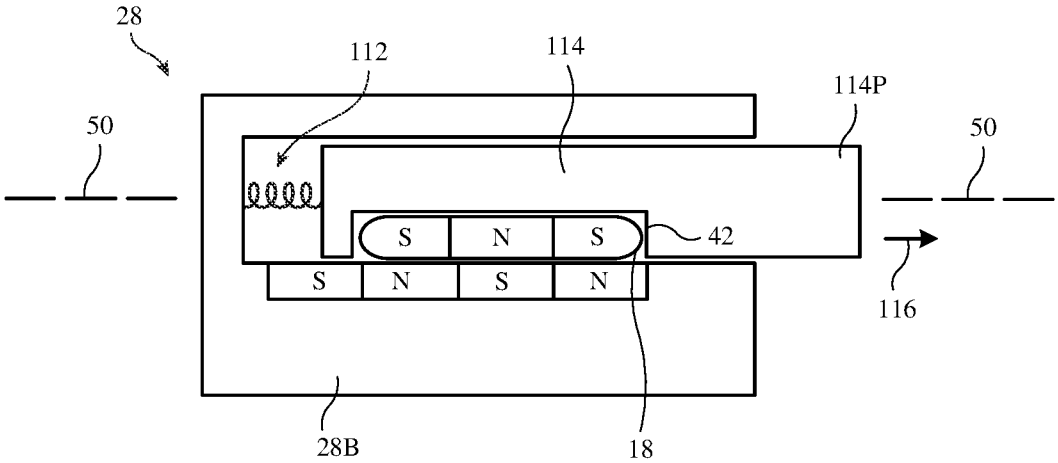

Another illustrative configuration for slider 28 that uses magnetic attraction and repulsion to lock and unlock slider 28 is shown in FIG. 16. In this arrangement, strip 18 is magnetized along its length (e.g., using strip-shaped flexible magnet poles of alternating S-N-S polarity in this example), whereas plunger member 114 is not magnetized. Member 114 may have a slot that receives strip 18. Spring 112 may bias plunger member end portion 114P of member 114 in direction 116. This laterally shifts the position of strip 18 in slider 28 (e.g., strip 18 is moved parallel to axis 50) and causes the poles of strip 18 to be aligned with corresponding poles of opposite polarity in body 28B. In particular, as shown in FIG. 16, the shifting of strip 18 in direction 116 causes south poles S of strip 18 to align with north poles N of body 28B and causes north pole N of strip 18 to align with south pole S of body 28B. The opposing poles of strip 18 and body 28B cause mutual attraction. This magnetic force holds strip 18 in place against body 28B and locks slider 28 in place on strip 18. When it is desired to unlock slider 28, a user may press inwardly on portion 114P to compress spring 112 and shift the poles of strip 18 into alignment with poles of the same polarity in body 28B. The resulting magnetic repulsion between strip 118 and the magnets of body 28B releases strip 118 from body 28B and allows strip 118 to slide freely relative to slider 28.

Figure 17:
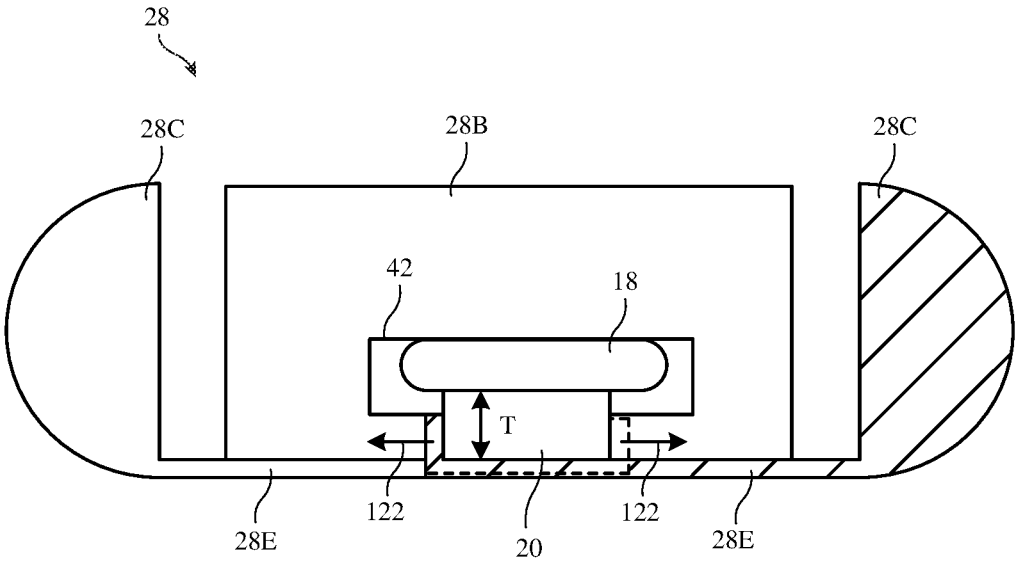
FIGS. 17, 18, and 19 are cross-sectional views of illustrative sliders with stretchable brakes in accordance with embodiments.
Figure 18:
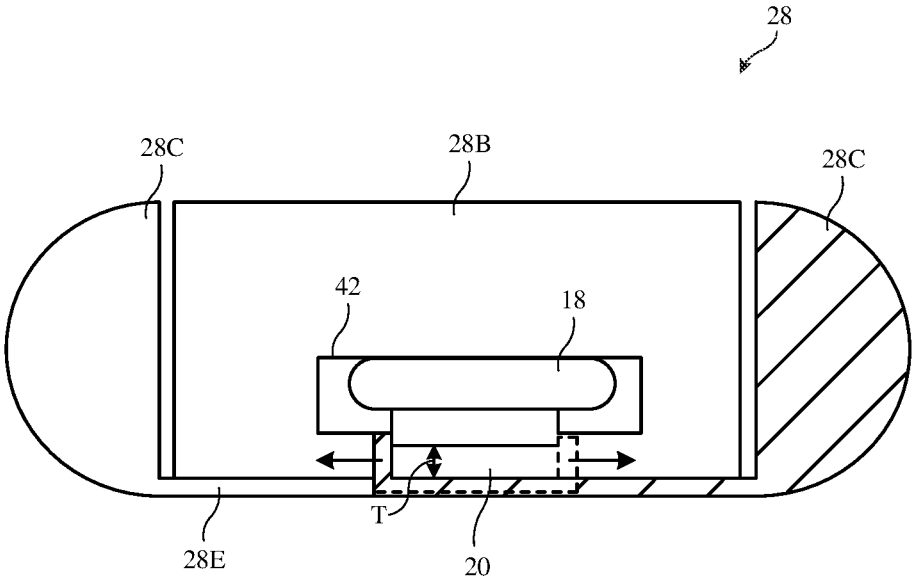

In the example of FIGS. 17 and 18, end caps 28C have been provided with elongated portions 28E that are attached at their far ends to opposing left and right edges of elastomeric brake member 120. Member 120 may be, for example, a block of elastomeric polymer that thins when stretched. When end caps 28C are released, member 120 retracts along its length and has a first, relatively larger, thickness T, as shown in FIG. 17. This causes member 120 to press against strip 18 in slot 42, serving as a strap brake.

When it is desired to unlock strip 18, end caps 28C may be pressed towards each other by a user. This pulls outwardly in directions 122 on the opposing ends of member 120, thereby stretching member 120 and thinning member 120, as shown in FIG. 18. When thickness T of member 120 is reduced in this way, strip 18 is released from member 120 and is allowed to slide freely within slot 42 (e.g., the stretching and thinning of elastomeric member 120 unlocks slider 28). After the position of slider 28 along strip 18 has been adjusted as desired, the use may release end caps 28C to allow elastomeric member 120 to contract inwardly along its length. This increases thickness T of member 120 and causes member 120 to lock strip 18 in place.

Figure 19:
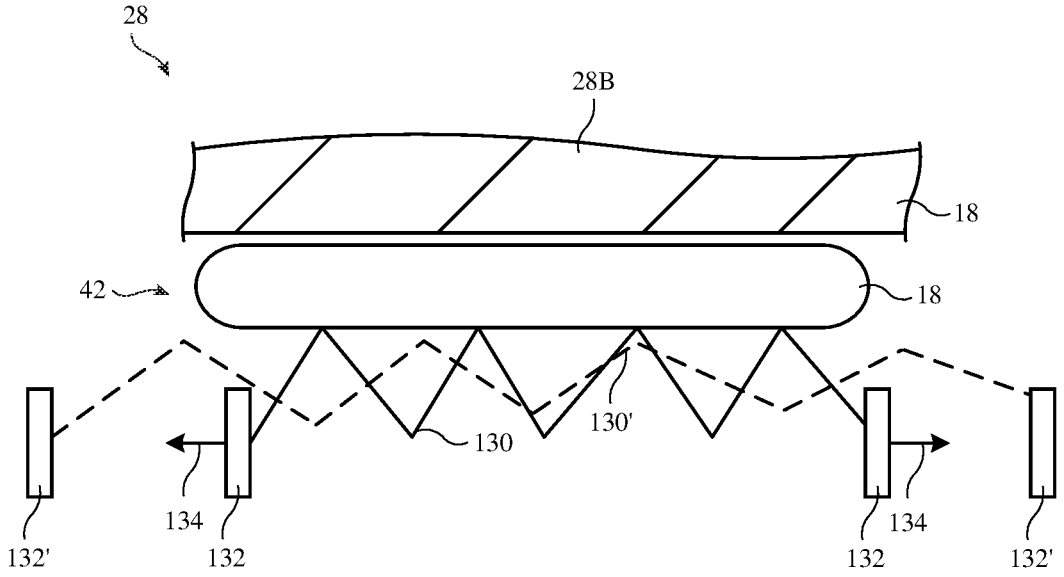

If desired, other types of stretchable structures may be used to form an adjustable slider brake for slider 28. As an example, a spring formed from spring metal or other materials may be used in slider 28. This type of arrangement is shown in FIG. 19. As shown in FIG. 19, slider 28 may have a slot in body 28B such as slot 42 in which strip 18 may be received. Spring 130 may be formed from an accordion-type spring member or other spring member shape that can stretch. End caps 28C or other portions of slider 28 may be provided with portions such as members 132 attached to opposing ends of spring 130 (e.g., the member 132 on the left of FIG. 19 may be coupled to an end cap 28C on the right of slider 28 and the member 132 on the right of FIG. 19 may be coupled to an end cap 28C on the left of slider 28). Spring 130 tends to contract along its length, which causes its thickness to increase and causes portions of spring 130 to bear against strip 18 to hold strip 18 in place. When it is desired to unlock slider 28 of FIG. 19, end caps 28C may be pressed inwardly, causing members 132 to move outwardly in directions 134 to positions 132' and thereby causing spring 130 to stretch outwardly to stretched position 130'. The stretching of spring 130 in this way causes the spring to exhibit reduced thickness and pull away from strap 18. This unlocks slider 28 and releases strip 18 so that strip 18 can slide within slot 42.

As described above, one aspect of the present technology is the gathering and use of information such as information from input-output devices. The present disclosure contemplates that in some instances, data may be gathered that includes personal information data that uniquely identifies or can be used to contact or locate a specific person. Such personal information data can include demographic data, location-based data, telephone numbers, email addresses, twitter ID's, home addresses, data or records relating to a user's health or level of fitness (e.g., vital signs measurements, medication information, exercise information), date of birth, username, password, biometric information, or any other identifying or personal information.

The present disclosure recognizes that the use of such personal information, in the present technology, can be used to the benefit of users. For example, the personal information data can be used to deliver targeted content that is of greater interest to the user. Accordingly, use of such personal information data enables users to have control of the delivered content. Further, other uses for personal information data that benefit the user are also contemplated by the present disclosure. For instance, health and fitness data may be used to provide insights into a user's general wellness, or may be used as positive feedback to individuals using technology to pursue wellness goals.

The present disclosure contemplates that the entities responsible for the collection, analysis, disclosure, transfer, storage, or other use of such personal information data will comply with well-established privacy policies and/or privacy practices. In particular, such entities should implement and consistently use privacy policies and practices that are generally recognized as meeting or exceeding industry or governmental requirements for maintaining personal information data private and secure. Such policies should be easily accessible by users, and should be updated as the collection and/or use of data changes. Personal information from users should be collected for legitimate and reasonable uses of the entity and not shared or sold outside of those legitimate uses. Further, such collection/sharing should occur after receiving the informed consent of the users. Additionally, such entities should consider taking any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices. In addition, policies and practices should be adapted for the particular types of personal information data being collected and/or accessed and adapted to applicable laws and standards, including jurisdiction-specific considerations. For instance, in the United States, collection of or access to certain health data may be governed by federal and/or state laws, such as the Health Insurance Portability and Accountability Act (HIPAA), whereas health data in other countries may be subject to other regulations and policies and should be handled accordingly. Hence different privacy practices should be maintained for different personal data types in each country.

Despite the foregoing, the present disclosure also contemplates embodiments in which users selectively block the use of, or access to, personal information data. That is, the present disclosure contemplates that hardware and/or software elements can be provided to prevent or block access to such personal information data. For example, the present technology can be configured to allow users to select to "opt in" or "opt out" of participation in the collection of personal information data during registration for services or anytime thereafter. In another example, users can select not to provide certain types of user data. In yet another example, users can select to limit the length of time user-specific data is maintained. In addition to providing "opt in" and "opt out" options, the present disclosure contemplates providing notifications relating to the access or use of personal information. For instance, a user may be notified upon downloading an application ("app") that their personal information data will be accessed and then reminded again just before personal information data is accessed by the app.

Moreover, it is the intent of the present disclosure that personal information data should be managed and handled in a way to minimize risks of unintentional or unauthorized access or use. Risk can be minimized by limiting the collection of data and deleting data once it is no longer needed. In addition, and when applicable, including in certain health related applications, data de-identification can be used to protect a user's privacy. De-identification may be facilitated, when appropriate, by removing specific identifiers (e.g., date of birth, etc.), controlling the amount or specificity of data stored (e.g., collecting location data at a city level rather than at an address level), controlling how data is stored (e.g., aggregating data across users), and/or other methods.

Therefore, although the present disclosure broadly covers use of information that may include personal information data to implement one or more various disclosed embodiments, the present disclosure also contemplates that the various embodiments can also be implemented without the need for accessing personal information data. That is, the various embodiments of the present technology are not rendered inoperable due to the lack of all or a portion of such personal information data.

The foregoing is merely illustrative and various modifications can be made to the described embodiments. The foregoing embodiments may be implemented individually or in any combination.

What is claimed is:

1. An adjustable strap for an item, comprising:

a strip of material configured to couple to the item; and a sliding clasp having a first portion that is attached to an end of a first segment of the strip of material and that has a slot configured to receive a second segment of the strip of material for sliding motion within the slot and having a second portion that rotates relative to the first portion, wherein the first and second portions are configured to rotate relative to each other between: 1) a locked position in which a brake presses against the strip of material and holds the strip of material in place relative to the sliding clasp and 2) An unlocked position in which the brake does not press on the strip of material and the strip of material slides relative to the sliding clasp, wherein the strip of material extends through the slot along a first axis, and wherein the first portion rotates relative to the second portion about a second axis that is perpendicular to the first axis.

2. The adjustable strap defined in claim 1 wherein the second portion comprises first and second end caps, the adjustable strap further comprising a spring configured to rotate the first and second portions into the locked position, wherein brake comprises pins coupled between the first and second end caps, wherein the first portion includes the slot, and wherein the spring is configured to rotate the first and second portions into the locked position.

3. The adjustable strap defined in claim 1 wherein the brake comprises a pin in the second portion, wherein the first portion has crescent-shaped slots, and wherein the pin slides in the slots.

4. The adjustable strap defined in claim 3 wherein the first portion comprises a body, wherein the slot is in the body, wherein the second portion comprises end caps coupled by the pin, and wherein the end caps are configured to rotate relative to the body.

5. The adjustable strap defined in claim 4 further comprising a spring with one end coupled to the body and one end coupled to one of the end caps, wherein the spring is configured to rotate the first and second portions into the locked position.

6. The adjustable strap defined in claim 1 wherein the brake comprises first and second pins, wherein the strip has opposing first and second surfaces, and wherein the first pin is configured to press against the first surface in the locked position and the second pin is configured to press against the second surface in the locked position.

7. A strap for an item, comprising:

a strip of material configured to couple to the item; and a sliding clasp having a body with a longitudinal axis that extends along a first direction, an end cap, a first slot that receives a first segment of the strip of material, a second slot that is parallel to the first slot and that receives a second segment of the strip of material that overlaps and is parallel to the first segment, and brake pads configured to move towards and away from the first segment of the strip of material in response to movement of the end cap relative to the body, wherein the first and second slots are stacked in a second direction that is perpendicular to the first direction, and wherein the sliding clasp is operable in:

a locked mode in which the brake pads hold the first segment of the strip of material in place in the first slot; and an unlocked mode in which the brake pads allow the first segment of the strip of material to slide through the first slot along a third direction that is perpendicular to the first and second directions while the second segment of the strip of material remains fixed within the second slot.

8. The strap defined in claim 7 further comprising springs, wherein each spring is configured to bias a respective one of the brake pads.

9. The strap defined in claim 8 further comprising an elongated member having cam surfaces configured to bear against the brake pads.

10. The strap defined in claim 9 wherein the body is configured to receive the elongated member, wherein the elongated member is configured to move between a first position in which the brake pads are moved away from the strip and a second position in which the brake pads are moved towards the strip.

11. The strap defined in claim 10 further comprising a biasing structure configured to push the elongated member into the second position.

12. The strap defined in claim 10 further comprising a biasing structure configured to push the elongated member into the first position.

13. A strap for an item, comprising:

a strip of material configured to couple to the item; and a sliding clasp having a longitudinal axis that extends along a first direction, a first slot that receives a first segment of the strip of material, and a second slot that is parallel to the first slot and that receives a second segment of the strip of material that overlaps and is parallel to the first segment of the strip of material, wherein the first and second slots are stacked in a second direction that is perpendicular to the first direction, and wherein the sliding clasp has a locking mechanism operable in:

a locked mode in which the locking mechanism holds the first segment of the strip of material in place in the first slot; and an unlocked mode in which the locking mechanism allows the first segment of the strip of material to slide through the first slot along a third direction that is perpendicular to the first and second directions while the second segment of the strip of material remains fixed within the second slot.

14. The strap defined in claim 13 wherein the locking mechanism comprises a roller, wherein the sliding clasp has a body in which the first and second slots are formed, and wherein the sliding clasp has a portion with a shaft that slides into and out of the body.

15. The strap defined in claim 14 further comprising a tapered structure on the shaft, wherein the shaft is configured to move between: 1) a locked position in which the tapered structure is pressed against the roller and prevents the roller from rotating in the locked mode; and 2) an unlocked position in which the tapered structure is not pressed against the roller and does not prevent the roller from rotating in the unlocked mode.

16. The strap defined in claim 14 further comprising a tapered surface on the body, wherein the shaft is configured to move between: 1) a locked position in which the tapered surface is pressed against the roller and prevents the roller from rotating in the locked mode; and 2) an unlocked position in which the tapered surface is not pressed against the roller and does not prevent the roller from rotating in the unlocked mode.

17. The strap defined in claim 16 further comprising an additional roller and an additional shaft that slides in and out of the body.

18. The strap defined in claim 17 further comprising a spring configured to press the shaft and the additional shaft from each other.

19. The strap defined in claim 13 wherein the locking mechanism comprises a magnet.

20. The strap defined in claim 19 wherein the sliding clasp has a body in which the magnet is mounted and has a sliding member that slides relative to the body.

21. The strap defined in claim 20 further comprising an additional magnet on the sliding member, wherein the additional magnet is attracted towards the magnet and holds the strip in place in the locked mode and repels the magnet to allow the strip to slide in the unlocked mode.

22. The strap defined in claim 20 wherein the strip comprises a flexible magnet and wherein the sliding member is configured to:

hold the flexible magnet in a first position in the locked mode in which the flexible magnet attracts the magnet to hold the strip at the fixed position relative to the sliding clasp; and hold the flexible magnet in a second position in the unlocked mode in which the flexible magnet repels the magnet and allows the strip to slide relative to the sliding clasp.

23. The strap defined in claim 13 wherein the locking mechanism comprises a stretchable member, wherein:

the stretchable member is not stretched and has a first thickness in the locked mode, holding the strip in a fixed position relative sliding clasp; and the stretchable member is stretched and has a second thickness that is less than the first thickness in the unlocked mode, allowing the strip to slide through the sliding clasp.

24. The strap defined in claim 23 wherein the sliding clasp has a body and a pair of end caps with portions coupled to the stretchable member, wherein the end caps are located a first distance apart in the locked mode, and wherein the end caps are located a second distance apart that is less than the first distance in the unlocked mode.

25. The strap defined in claim 24 wherein the stretchable member comprises an elastomeric member.

26. The strap defined in claim 24 wherein the stretchable member comprises a spring.

* * * * *